US010086496B2

(12) United States Patent
Chen

(10) Patent No.: US 10,086,496 B2
(45) Date of Patent: Oct. 2, 2018

(54) SAFETY COVER FOR SAND GRINDER

(71) Applicant: TRANMAX MACHINERY CO., LTD., Taichung (TW)

(72) Inventor: Hsin-Chi Chen, Taichung (TW)

(73) Assignee: TRANMAX MACHINERY CO., LTD., Taichung (TW)

( * ) Notice: Subject to any disclaimer, the term of this patent is extended or adjusted under 35 U.S.C. 154(b) by 35 days.

(21) Appl. No.: 15/499,275

(22) Filed: Apr. 27, 2017

(65) Prior Publication Data

US 2018/0236634 A1 Aug. 23, 2018

(30) Foreign Application Priority Data

Feb. 23, 2017 (TW) ..... 106106159 A

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/052; B24B 23/028
USPC ..... 451/359, 451–457
See application file for complete search history.

(56) References Cited

U.S. PATENT DOCUMENTS 6,848,984 B2 * 2/2005 Bohler ..... B24B 19/26 451/342
7,892,075 B2 * 2/2011 Esenwein ..... B24B 55/052 451/344
8,221,197 B2 * 7/2012 Boeck ..... B24B 23/00 451/344
8,454,412 B2 * 6/2013 Esenwein ..... B24B 55/052 451/344
2004/0203330 A1 * 10/2004 Kleider ..... B24B 23/028 451/359
2004/0224621 A1 * 11/2004 Fraser ..... B23Q 11/005 451/359
2005/0009458 A1 * 1/2005 Uzumcu ..... B23D 47/126 451/359
2007/0117499 A1 * 5/2007 Chen ..... B24B 23/028 451/451
2010/0304649 A1 * 12/2010 Sugiura ..... B24B 23/02 451/452
2012/0184193 A1 * 7/2012 Numata ..... B24B 23/02 451/453

* cited by examiner

*Primary Examiner* — George Nguyen
(74) *Attorney, Agent, or Firm* — Muncy, Geissler, Olds & Lowe, P.C.

(57) ABSTRACT

A safety cover used in a sand grinder is disclosed to include a cover body rotatably mounted at the base of the sand grinder around the sand wheel and having equiangularly spaced oval locating holes, a positioning device selectively engaged into one of the oval locating holes, and a switching lever mounted at the base and biasable between a locking position where an abutment portion of the switching lever is abutted against the positioning device to lock the positioning device in one oval locating hole and an unlocking position where a bearing portion of the switching lever faces toward the positioning device for enabling the positioning device to be disengaged from the respective oval locating hole.

5 Claims, 8 Drawing Sheets

SAFETY COVER FOR SAND GRINDER

BACKGROUND OF THE INVENTION

1. Field of the Invention

The present invention relates to grinding technology, and more particularly to a safety cover for sand grinder.

2. Description of the Related Art

When using a sand grinder, in order to avoid sparks from flashing toward the user due to the effect of a centrifugal force generated during grinding between the sand wheel and the workpiece, the sand wheel will have a part thereof be guarded by a safety cover, allowing a front part of the sand wheel to exposed to the outside for grinding the workpiece.

In order to mate with the grinding angle of the sand wheel, the safety cover is normally designed for allowing adjustment of the angular position. However, before adjusting the angular position of a conventional safety cover, the user needs to unlock the safety cover using a tool (such as screwdriver). After adjustment of the angular position of the safety cover, the user needs to lock the safety cover again. However, when using a tool to lock or unlock the safety cover, the user's hand can touch the sand wheel that is not completely stopped, resulting in finger injuries. Therefore, a structural improvement in this regard is necessary.

SUMMARY OF THE INVENTION

The present invention has been accomplished under the circumstances in view. It is the main object of the present invention to provide a safety cover for sand grinder, which facilitates angular adjustment and ensures a high level of operating safety.

To achieve this and other objects of the present invention, a safety cover used in a sand grinder comprises a cover body, a positioning device and a switching lever. The cover body is mounted at the base and rotatably surrounding a part of an outer perimeter of the sand wheel, comprising a plurality of oval locating holes. The positioning device comprises a movable pin adapted for selectively engaging into one of the oval locating holes of the cover body subject to rotation of the cover body relative to the sand wheel. The switching lever is mounted at the base and biasable relative to the base between a locking position and an unlocking position. Further, the switching lever comprises an abutment portion, and a bearing portion adjoined to the abutment portion. Further, the distance between the abutment portion of the switching lever and the cover body is shorter than the distance between the bearing portion of the switching lever and the cover body. Thus, when the switching lever is not biased by an external force and set in the locking position, the abutment portion of the switching lever is abutted against the positioning device to lock the positioning device in one oval locating hole of the cover body. At this time, the cover body is prohibited from rotation relative to the sand wheel. On the contrary, when the switching lever is switched from into the unlocking position by an external force, the bearing portion of the switching lever faces toward the positioning device, causing the switching lever to release the pressure from the positioning device. At this time, the cover body can easily be rotated to move the positioning device, causing the positioning device to be disengaged from the respective oval locating hole of the cover body. After adjustment of the cover body to the desired angle, the switching lever is switched back to the locking position to finish the positioning of the cover body. The whole operation process is very simple and convenient, avoiding accidental finger injury.

Preferably, the switching lever comprises an elongated slot, having two opposite ends of a part thereof around the elongated slot configured to face toward the cover body and to form the abutment portion and the bearing portion respectively. The movable pin is axially movable inserted through the elongated slot of the switching lever, comprising a flange. The flange is abutted against the abutment portion of the switching lever when the switching lever is set in the locking position, or facing toward the bearing portion of the switching lever when the switching lever is set in the unlocking position. The positioning device further comprises a ball mounted in a bottom end of the movable pin and selectively engaged into one of the oval locating holes, and a positioning spring member supported between an opposing bottom end of the movable pin and the base for imparting an elastic restoring energy to force the ball toward the cover body so that the ball can be automatically engaged into any one of the oval locating holes it touches.

Preferably, the base comprises a screw bolt mounting hole. Further, the switching lever comprises an upright end wall, and a through hole cut through the upright end wall. Preferably, the safety cover further comprises a screw bolt, an end cap and a return spring. The screw bolt comprises a head, and a threaded shank extended from the head and inserted through the through hole of the switching lever and threaded into the screw bolt mounting hole of the base. The end cap is capped on the threaded shank of the screw bolt and disposed between the upright end wall of the switching lever and the head of the screw bolt. Further, the return spring is supported between the upright end wall of the switching lever and the end cap for providing an elastic restoring energy to hold the switching lever in the locking position.

Preferably, the switching lever further comprises a finger grip located at one end thereof and movable by an external force to bias the switching lever from the locking position to the unlocking position.

Preferably, the oval locating holes of the cover body are equiangularly spaced from one another Other and further benefits, advantages and features of the present invention will be understood by reference to the following specification in conjunction with the accompanying drawings, in which like reference characters denote like elements of structure.

DETAILED DESCRIPTION OF THE INVENTION

Figure 1:
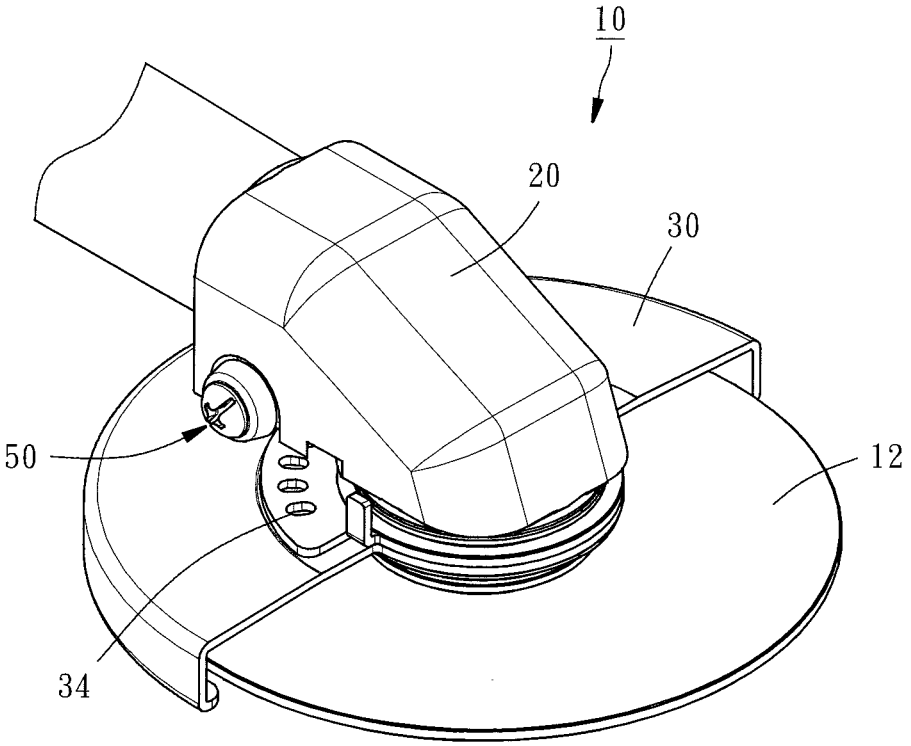
FIG. 1 is an oblique elevational view of a safety cover used in a sand grinder in accordance with the present invention.
Figure 2:
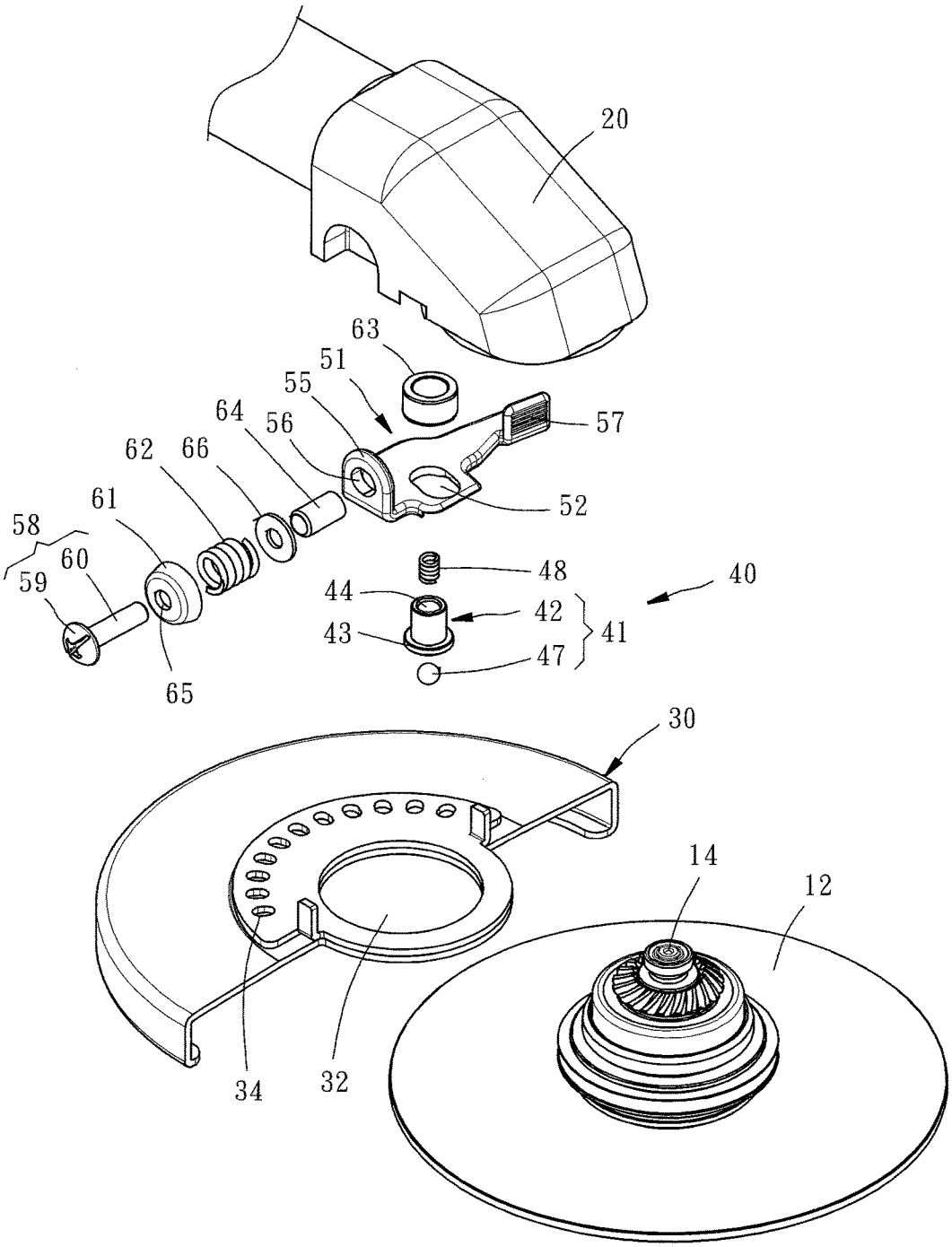
FIG. 2 is an exploded view of the safety cover in accordance with the present invention.
Figure 3:
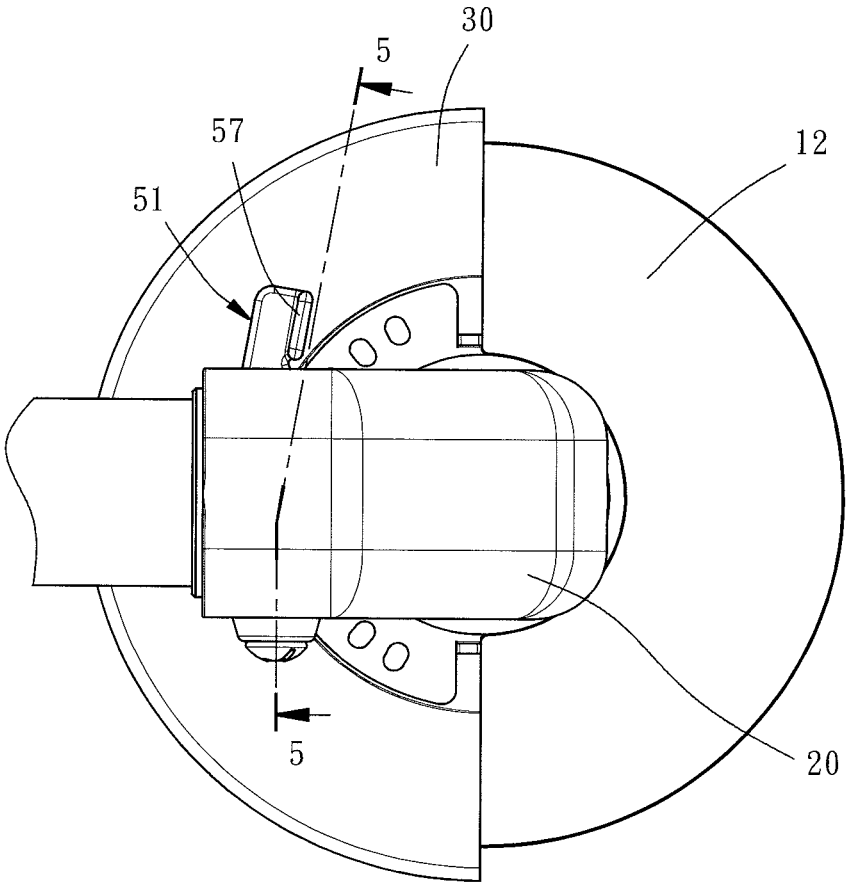
FIG. 3 is a schematic top view of the present invention, illustrating the switching lever in the locking position.
Figure 4:
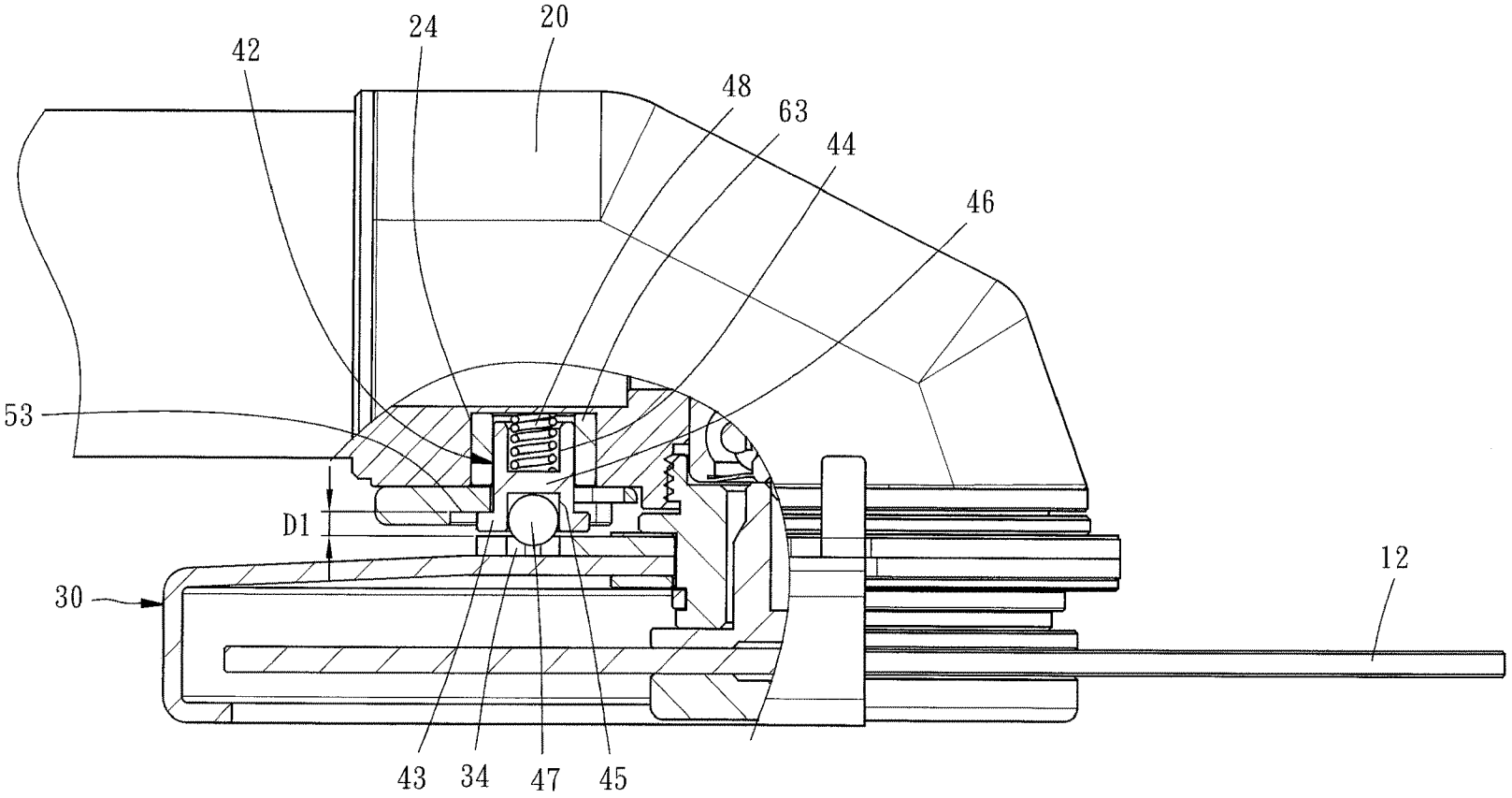
FIG. 4 is a schematic sectional view of a part of the present invention, illustrating the switching lever forced against the movable pin.
Figure 5:
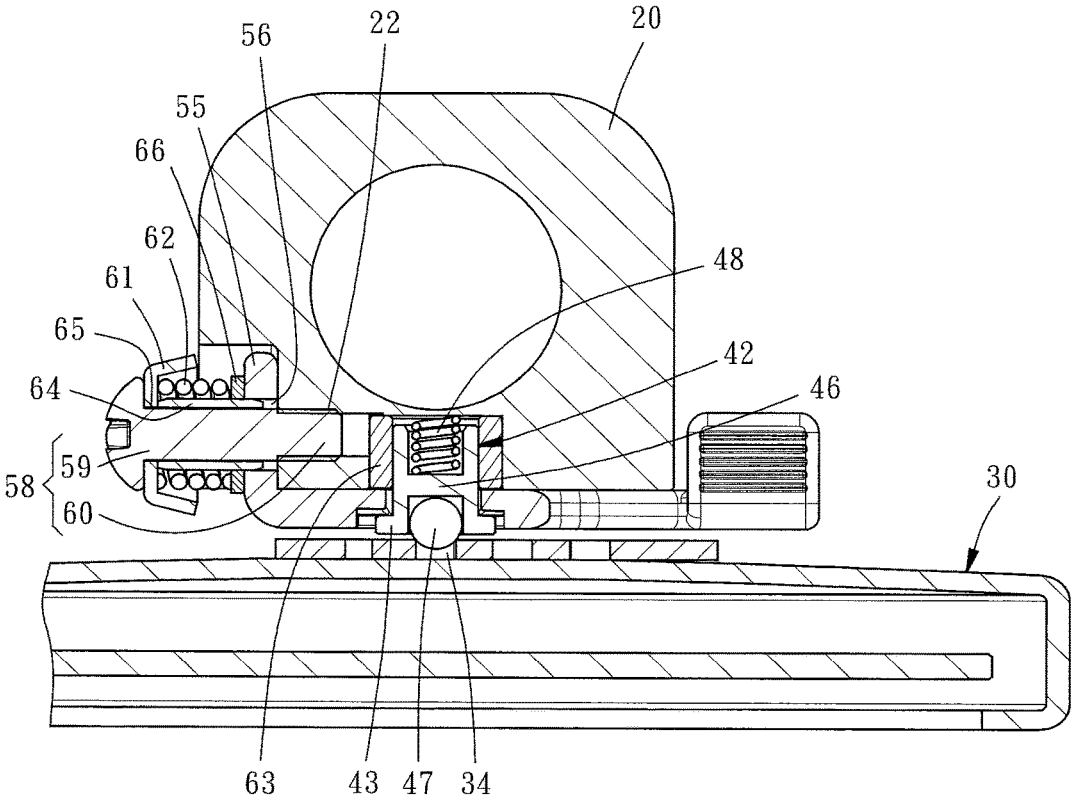
FIG. 5 is a sectional view taken along line 5-5 of FIG. 3.

Referring to FIGS. 1 and 2, a safety cover 10 in accordance with the present invention is shown mounted at a sander grinder's base 20. In the present preferred embodiment, the base 20 is particularly tilted at the front end for easy grinding. The sand wheel 12 of the sand grinder is rotatably mounted at the base 20 through a transmission mechanism 14. Further, as illustrated in FIG. 4 and FIG. 5, the base 20 has a screw bolt mounting hole 22 located at one lateral side thereof, and an accommodation chamber 24 depressed a bottom wall thereof.

The safety cover 10 comprises a cover body 30, a positioning device set 40 and a switching mechanism 50. The cover body 30 is mounted between the sand wheel 12 and the base 20 to surround the outer perimeter of the sand wheel 12, allowing a part of the sand wheel 12 to expose to the outside. Further, the cover body 30 has an axle hole 32 at the center. By means of the axle hole 32, the cover body 30 is rotatably coupled to the transmission mechanism 14. The cover body 30 further has a plurality of oval locating holes 34 equiangularly spaced around the axle hole 32. The oval shape of the locating holes 34 increases the positioning tolerance.

The positioning device set 40 comprises a positioning device 41 and a bushing 63. The positioning device 41 comprises a movable pin 42. The movable pin 42 has the top end thereof suspended in the accommodation chamber 24 of the base 20, and the opposing bottom end thereof provided with a flange 43. Further, as illustrated in FIG. 4, the movable pin 42 defines therein a top receiving hole 44, a bottom receiving hole 45, and a partition wall 46 disposed between the top receiving hole 44 and the bottom receiving hole 45. Further, a ball 47 is accommodated in the bottom receiving hole 45. As illustrated in FIG. 2 and FIG. 4, the bushing 63 is disposed in the accommodation chamber 24 of the base 20, and sleeved onto the top end of the movable pin 42 so that the movable pin 42 can maintain good operating smoothness. The positioning device set 40 further comprises a positioning spring member 48 mounted in the top receiving hole 44 of the movable pin 42 and respectively stopped with the opposing top and bottom ends thereof against the base 20 and the partition wall 46 of the movable pin 42. Thus, the elastic restoring energy of the positioning spring member 48 forces the movable pin 42 to push the ball 47 toward the cover body 30, enabling the ball 47 to be automatically engaged into one of the series of oval locating holes 34.

The switching mechanism 50 comprises a switching lever 51, a screw bolt 58, an end cap 61, a return spring 62 and a sleeve 64.

Figure 6:
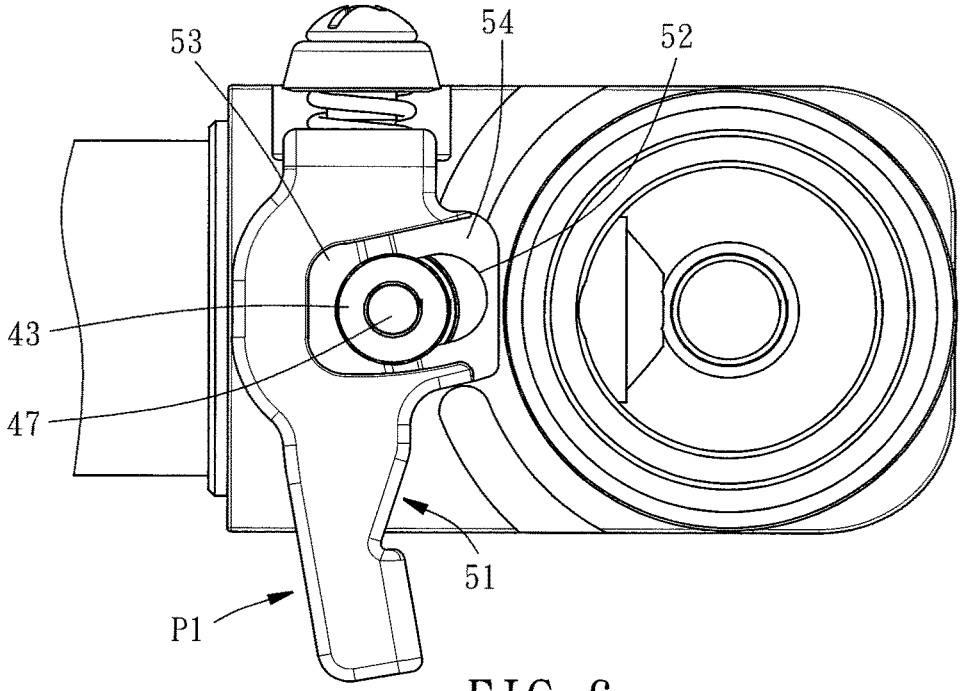
FIG. 6 is a schematic bottom view of a part of the present invention, illustrating the switching lever in the locking position.

As illustrated in FIG. 2, the switching lever 51 has an elongated slot 52 located on the middle and coupled to the movable pin 42 of the positioning device 41. Further, as illustrated in FIG. 6, the switching lever 51 has an abutment portion 53 located at the bottom wall thereof at one side of the elongated slot 52, and a bearing portion 54 located at the bottom wall thereof at an opposite side of the elongated slot 52 and adjoined to the abutment portion 53. Further, the distance D1 between the abutment portion 53 of the switching lever 51 and the cover body 30 (see FIG. 4) is shorter than the distance D2 between the bearing portion 54 of the switching lever 51 and the cover body 30 (see FIG. 9). Further, the switching lever 51 has an upright end wall 55 located at one end thereof, a through hole 56 cut through the upright end wall 55, and a finger grip 57 located at an opposite end thereof.

The screw bolt 58 has a head 59 and a threaded shank 60. As illustrated in FIG. 5, the threaded shank 60 has one end thereof connected to the head 59, and an opposite end thereof inserted through the through hole 56 of the switching lever 51 and threaded into the screw bolt mounting hole 22 of the base 20. Further, the outer diameter of the threaded shank 60 is smaller than the diameter of the through hole 56 of the switching lever 51. Thus, after the switching lever 51 is connected to the base 20 by the screw bolt 58, the switching lever 51 can still be biased relative to the base 20.

As illustrated in FIG. 2 and FIG. 5, the end cap 61 has a coupling hole 65 coupled to the threaded shank 60 of the screw bolt 58, and is disposed between the upright end wall 55 of the switching lever 51 and the head 59 of the screw bolt 58.

The sleeve 64 is sleeved onto the threaded shank 60 of the screw bolt 58, having one end thereof inserted into the through hole 56 of the switching lever 51 and an opposite end thereof stopped against an inside wall of the end cap 61.

As illustrated in FIG. 2 and FIG. 5, the return spring 62 is mounted around the sleeve 64, having one end thereof stopped against the inside wall of the end cap 61 and an opposite end thereof stopped against the upright end wall 55 of the switching lever 51 by means of a washer 66. Thus, the return spring 62 can impart an elastic restoring energy to return the switching lever 52 after the switching lever 52 having been biased.

Referring to FIGS. 3-6, when the switching lever 51 receives no pressure, it is maintained in a locking position P1 where the abutment portion 53 of the switching lever 51 is abutted against the flange 43 of the movable pin 42, and the ball 47 is pushed by the partition wall 46 of the movable pin 42 into engagement with one oval locating hole 34 of the cover body 30, at this time, the cover body 30 is prohibited from rotation.

Figure 7:
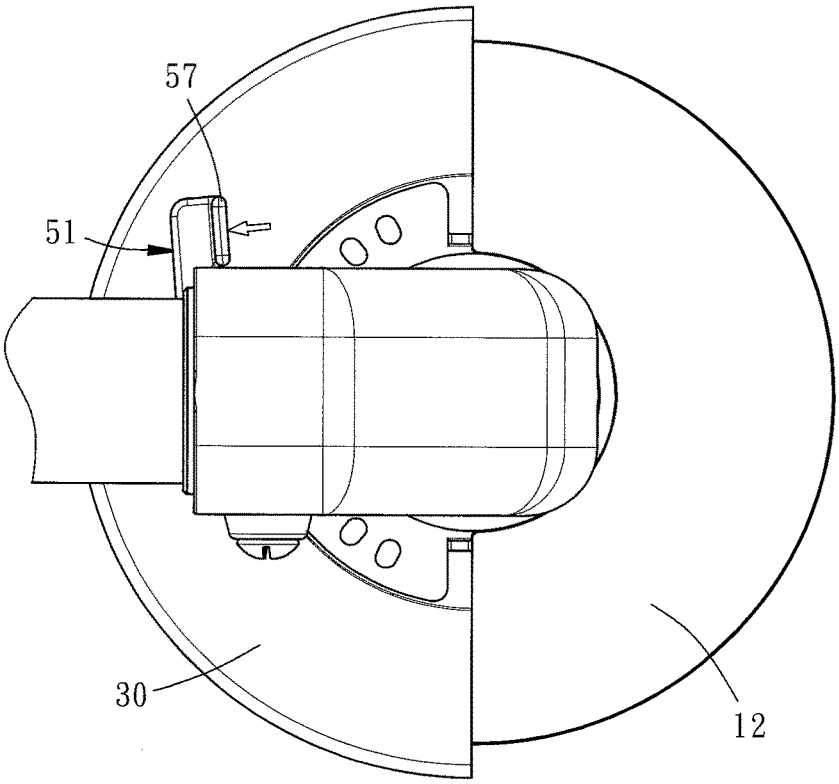
FIG. 7 is a schematic top view of the present invention, illustrating the switching lever in the unlocking position.
Figure 8:
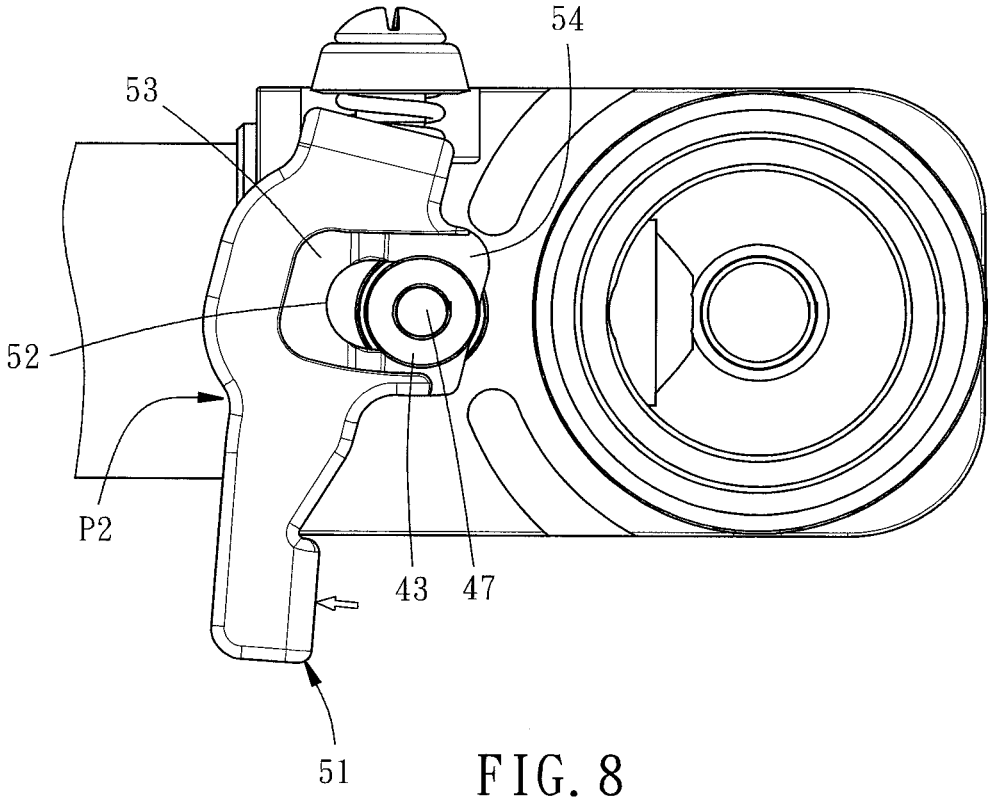
FIG. 8 is a schematic bottom view of a part of the present invention, illustrating the switching lever in the unlocking position.
Figure 9:
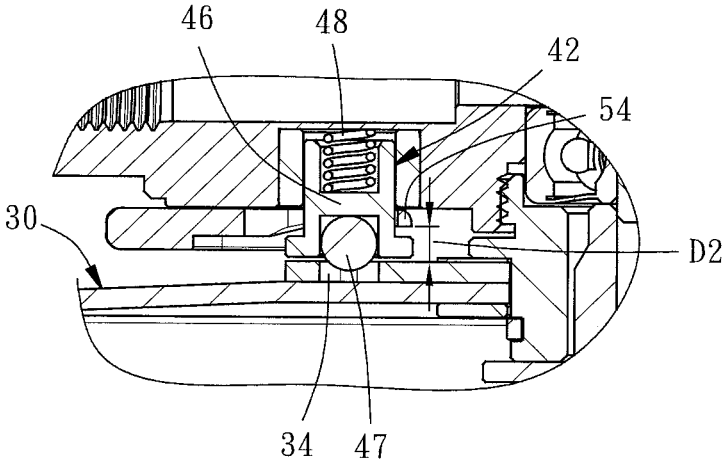
FIG. 9 is a schematic sectional view of a part of the present invention, illustrating the switching lever released from the movable pin.
Figure 10:
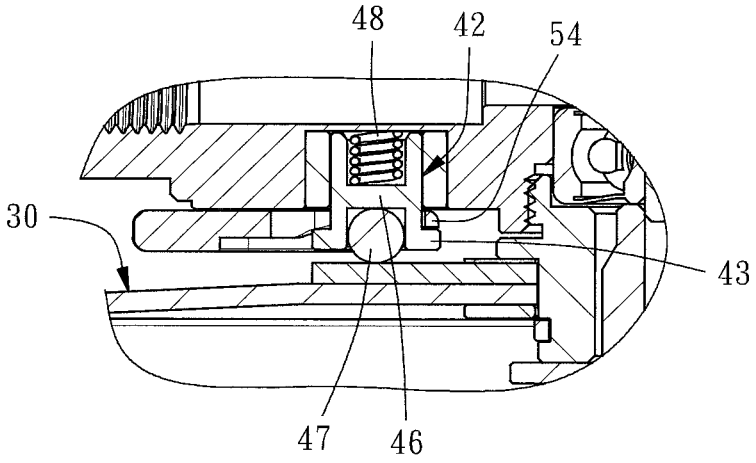
FIG. 10 is similar to FIG. 9, illustrating the ball disengaged from the respective oval locating hole.
Figure 11:
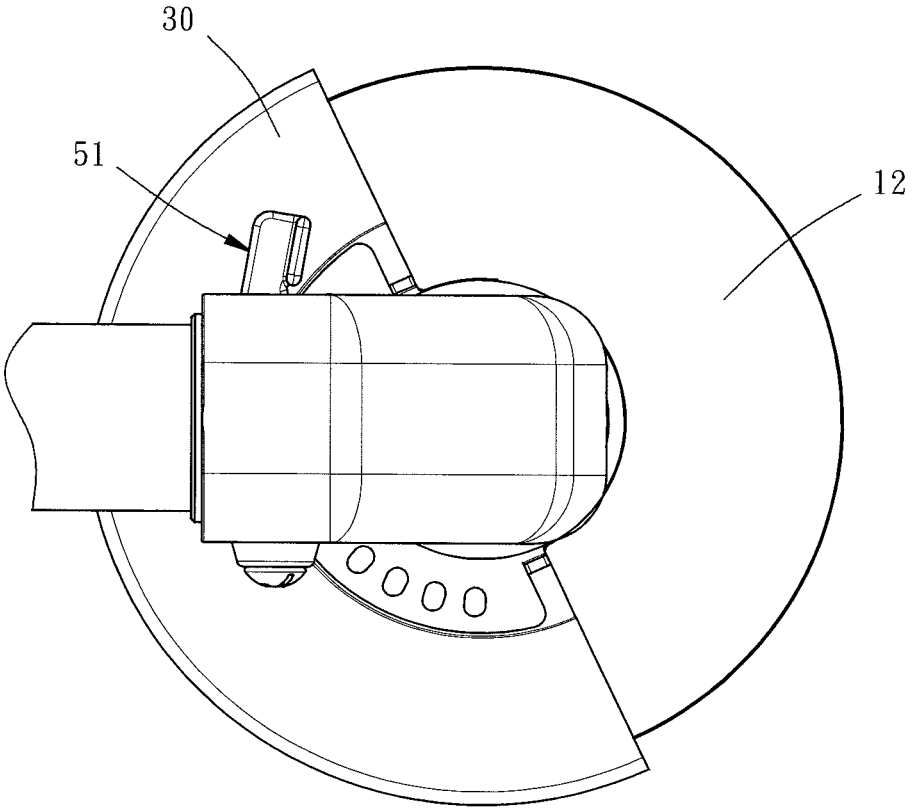
FIG. 11 is a schematic top view of the present invention, illustrating the angular position of the safety cover adjusted.

If there is an angle adjustment requirement, as illustrated in FIG. 7 and FIG. 8, use the fingers of one hand to grip the finger grip 57 of the switching lever 51 and to further bias the switching lever 51 from the locking position P1 to an unlocking position P2. At this time, as shown in FIG. 9, the bearing portion 54 of the switching lever 51 faces toward the flange 43 of the movable pin 42. Due to that the distance D2 between the bearing portion 54 of the switching lever 51 and the cover body 30 is larger than the distance D1 between the abutment portion 53 of the switching lever 51 and the cover body 30, the switching lever 51 can release the pressure from the movable pin 42, causing the movable pin 42 to release the pressure from the ball 47, however, under the effect of the elastic restoring energy of the positioning spring member 48, the partition wall 46 of the movable pin 42 keeps holding down the ball 47 in the respective oval locating hole 34. Thereafter, use the other hand to rotate the cover body 30. During rotation of the cover body 30, the ball 47 will be forced by the hole wall of the respective oval locating hole 34 to push the partition wall 46 of the movable pin 42 upward, forcing the flange 43 to abut against the bearing portion 54 of the switching lever 50. When the movable pin 42 is being moved upward, as illustrated in FIG. 10, the positioning spring member 48 is compressed by the partition wall 46 to store an elastic restoring energy. As soon as the movable pin 42 reaches one next oval locating hole 34, it is immediately pushed by the elastic restoring energy of the positioning spring member 48 to move downward, forcing the ball 47 into engagement with the next oval locating hole 34 to lock the cover body 30 in position. In other words, as long as the cover body 30 is being continuously rotated, the ball 47 will be engaged into and moved away from every touched oval locating hole 34. After the cover body 30 has been adjusted to the desired angle and the ball 47 has engaged into the corresponding oval locating hole 34, release the pressure from the finger grip 57 of the switching lever 51. At this time, the switching lever 51 will be pushed back to the locking position P1 by the elastic restoring energy of the return spring 62, and thus, the angular position adjustment of the cover body 30 is completed (see FIG. 11).

In conclusion, the safety cover 10 of the present invention utilizes the mating arrangement between the switching lever 51 and the positioning device 41, enabling the user to adjust the angular position of the cover body 30 easily and quickly. Further, during the adjustment operation, the user needs to use the two hands to achieve the operation, therefore, the user can effectively reduce the risk of contact with the sand wheel 12, enhancing operational safety.

What is claimed is:

1. A safety cover used in a sand grinder comprising a base and a sand wheel rotatably mounted at said base, the safety cover comprising:

a cover body mounted at said base and rotatably surrounding a part of an outer perimeter of said sand wheel, said cover body comprising a plurality of oval locating holes;

a positioning device comprising a movable pin adapted for selectively engaging into one of said oval locating holes of said cover body subject to rotation of said cover body relative to said sand wheel; and a switching lever mounted at said base and biasable relative to said base between a locking position and an unlocking position, said switching lever comprising an abutment portion and a bearing portion adjoined to said abutment portion, the distance between said abutment portion of said switching lever and said cover body being shorter than the distance between said bearing portion of said switching lever and said cover body, wherein when said switching lever is set in said locking position, said abutment portion of said switching lever is abutted against said positioning device to lock said positioning device in one said oval locating hole of said cover body; when said switching lever is set in said unlocking position, said bearing portion of said switching lever faces toward said positioning device for enabling said positioning device to be disengaged from the respective said oval locating hole of said cover body.

2. The safety cover as claimed in claim 1, wherein said switching lever comprises an elongated slot, having two opposite ends of a part thereof around said elongated slot configured to face toward said cover body and to form said abutment portion and said bearing portion respectively; said movable pin is axially movable inserted through said elongated slot of said switching lever, comprising a flange, said flange being abutted against said abutment portion of said switching lever when said switching lever is set in said locking position, said flange facing toward said bearing portion of said switching lever when said switching lever is set in said unlocking position; said positioning device further comprises a ball mounted in a bottom end of said movable pin and selectively engaged into one of said oval locating holes, and a positioning spring member supported between an opposing bottom end of said movable pin and said base.

3. The safety cover as claimed in claim 1, wherein said base comprises a screw bolt mounting hole; said switching lever further comprises an upright end wall, and a through hole cut through said upright end wall; said safety cover further comprises a screw bolt, an end cap and a return spring, said screw bolt comprising a head and a threaded shank extended from said head and inserted through said through hole of said switching lever and threaded into said screw bolt mounting hole of said base, said end cap being capped on said threaded shank of said screw bolt and disposed between said upright end wall of said switching lever and said head of said screw bolt, said return spring being supported between said upright end wall of said switching lever and said end cap.

4. The safety cover as claimed in claim 1, wherein said switching lever further comprises a finger grip located at one end thereof and movable by an external force to bias said switching lever from said locking position to said unlocking position.

5. The safety cover as claimed in claim 1, wherein said oval locating holes of said cover body are equiangularly spaced from one another.

* * * * *